United States Patent [19]

Matsubara et al.

[11] Patent Number: 5,040,448

[45] Date of Patent: Aug. 20, 1991

[54] ELECTRONIC MUSICAL INSTRUMENT WITH USER-PROGRAMMABLE TONE GENERATOR MODULES

[75] Inventors: Akinori Matsubara, Kokubunji; Kenichi Tsutsumi, Tachikawa; Youji Kaneko, Kokubunji; Takashi Akutsu, Akishima; Naofumi Tateishi, Oome, all of Japan

[73] Assignee: Casio Computer Co., Ltd., Tokyo, Japan

[21] Appl. No.: 443,079

[22] Filed: Nov. 27, 1989

Related U.S. Application Data

[63] Continuation of Ser. No. 256,399, Oct. 11, 1988, abandoned.

[30] Foreign Application Priority Data

Oct. 14, 1987 [JP] Japan ..... 62-259295
Oct. 14, 1987 [JP] Japan ..... 62-259296

[51] Int. Cl.[5] ..... G10H 7/00

[52] U.S. Cl. ..... 84/622; 84/604; 84/615; 84/627; 84/644; 84/DIG. 7

[58] Field of Search ..... 84/647, 653, 655, 659–660, 84/662, 663, 670, 617, 622, 624–627, 644, 604, 607, DIG. 7

[56] References Cited

U.S. PATENT DOCUMENTS

| | | | |
|---|---|---|---|
| 3,443,463 | 5/1969 | Campbell . | |
| 3,708,603 | 2/1973 | Keagle et al. | 84/1.24 X |
| 3,978,755 | 9/1976 | Woron | 84/1.24 |
| 4,134,321 | 1/1979 | Woron | 84/1.22 |
| 4,138,915 | 2/1979 | Nagai et al. | 84/1.22 |
| 4,142,434 | 3/1979 | Gross | 84/DIG. 10 |
| 4,186,642 | 2/1980 | Gross | 84/1.24 |
| 4,212,221 | 7/1980 | Woron | 84/1.26 |
| 4,224,856 | 9/1980 | Ando et al. | 84/1.24 X |
| 4,246,822 | 1/1981 | Deutsch | 84/1.01 |
| 4,249,447 | 2/1981 | Tomisawa | 84/1.23 X |
| 4,253,366 | 3/1981 | Hoskinsou et al. | 84/1.26 X |
| 4,256,002 | 3/1981 | Schwartz et al. | 84/1.01 |
| 4,262,573 | 4/1981 | Chibana | 84/1.01 |
| 4,281,574 | 8/1981 | Deutsch | 84/1.19 |
| 4,297,933 | 11/1981 | Nishimoto | 84/1.01 |
| 4,301,704 | 11/1981 | Nagai et al. | 84/1.22 |
| 4,319,508 | 3/1982 | Schwartz et al. | 84/1.01 |
| 4,429,605 | 2/1984 | Takauji | 84/1.23 X |
| 4,554,857 | 11/1985 | Nishimoto | 84/1.24 |
| 4,597,318 | 7/1986 | Nikaido et al. | 84/1.22 |
| 4,616,546 | 10/1986 | Uchiyama et al. | 84/1.01 |
| 4,641,564 | 2/1987 | Okamoto | 84/1.22 |
| 4,655,115 | 4/1987 | Nishimoto | 84/1.19 |
| 4,683,793 | 8/1987 | Deutsch | 84/1.01 |
| 4,700,390 | 10/1987 | Machida | 84/660 X |
| 4,747,332 | 5/1988 | Uchiyama et al. | 84/655 |
| 4,763,553 | 8/1988 | Nagai et al. | 84/1.19 X |
| 4,773,294 | 9/1988 | Iizuka | 84/1.19 X |
| 4,836,075 | 6/1989 | Armstrong | 84/1.01 |
| 4,936,185 | 6/1990 | Yamaguchi et al. | 84/670 |

*Primary Examiner*—A. T. Grimley
*Assistant Examiner*—Matthew S. Smith
*Attorney, Agent, or Firm*—Frishauf, Holtz, Goodman & Woodward

[57] ABSTRACT

An electronic material instrument includes a tone generator for synthesizing tones by using a number of time-division multiplexed (TDM) modules, an input unit for programming a connection configuration (tone synthesis algorithm) for the modules of each module pair, and a processing unit for converting the input program into control data for each module and transferring the control data to the tone generator. In one embodiment, each module pair is selectively operative in an addition mode, a phase mode or a ring modulation mode, independently of the modes selected for the other module pairs. It is thus possible to attain a tone synthesis desired by the user, and to make the best use of the capacity of the tone generator.

18 Claims, 11 Drawing Sheets

| OPCODE | OPERATION |
|---|---|
| 0X --- | $\Sigma \leftarrow \Sigma + W_{i-1}$ , $X_i \leftarrow \omega_i t$ |
| 1X --- | " $X_i \leftarrow R$ |
| 4X --- | $R \leftarrow R + W_{i-1}$ , $X_i \leftarrow \omega_i t$ |
| 7X --- | ——— $X_i \leftarrow R + W_{i-1}$ |
| 8X --- | $R \leftarrow W_{i-1}$ , $X_i \leftarrow \omega_i t$ |
| 9X --- | " $X_i \leftarrow R$ |
| AX --- | " $X_i \leftarrow W_{i-1}$ |
| X8 --- | $W \quad (E_i + R) \sin X_i$ |

| | BIT 7 6 5 4 3 2 1 0 | SW 1 2 3 |
|---|---|---|
| 0 C 0 | 0 0 0 0 0 X X X | DOWN DOWN LEFT |
| " 1 | 0 0 0 0 0 X X X | |
| " 0 | 0 0 0 0 0 X X X | UP DOWN RIGHT |
| " 1 | 1 0 1 0 0 X X X | |
| " 0 | 0 0 0 0 0 X X X | DOWN UP RIGHT |
| " 1 | 1 0 0 0 1 X X X | |

| OP CODE | | | | SW | | | | | | | |
|---|---|---|---|---|---|---|---|---|---|---|---|
| $OC_0$ | $OC_1$ | $OC_2$ | $OC_3$ | 1 | 2 | 3 | 4 | 5 | 6 | 7 | 8 |
| 00 | 80 | 40 | 10 | DOWN | DOWN | LEFT | LEFT | CENTER | DOWN | LEFT | RIGHT |
| 00 | A0 | 80 | 10 | UP | DOWN | RIGHT | SAME AS ABOVE | | | | |
| 00 | 88 | 80 | 10 | DOWN | UP | RIGHT | | | | | |
| 00 | 80 | 40 | 70 | DOWN | DOWN | LEFT | UP | DOWN | RIGHT | | |
| 00 | A0 | 80 | 70 | UP | DOWN | RIGHT | SAME AS ABOVE | | | | |
| 00 | 88 | 80 | 70 | DOWN | UP | RIGHT | | | | | |
| 00 | 80 | 40 | 98 | DOWN | DOWN | LEFT | CENTER | UP | RIGHT | | |
| 00 | A0 | 80 | 98 | UP | DOWN | RIGHT | SAME AS ABOVE | | | | |
| 00 | 88 | 80 | 98 | DOWN | UP | RIGHT | | | | | |

ELECTRONIC MUSICAL INSTRUMENT WITH USER-PROGRAMMABLE TONE GENERATOR MODULES

This application is a continuation of application Ser. No. 07/256,399, filed Oct. 11, 1988, now abandoned.

BACKGROUND OF INVENTION

This invention relates to electronic musical instruments and, more particularly, to a technology for designating how a tone generator synthesizes musical tones.

Electronic musical instruments with a tone generator for synthesizing musical tones using a plurality of waveform generation modules are known in the art. Such waveform generator modules can be connected to one another in various forms, and the entirety of the resultant connected structure specifies the way of synthesizing tones.

An electronic musical instrument disclosed in U.S. Pat. No. 4,554,857 (issued on Nov. 26, 1985) incorporates a set of tone synthesis algorithms each defining a connected structure of a plurality of waveform generator modules. Each tone synthesis algorithm has a uniquely assigned numerical value representing the name of the algorithm. A tone synthesis algorithm is specified by selecting an algorithm number by an input unit. The selected tone synthesis algorithm is executed by a tone generator having a plurality of time-division multiplexed (TDM) modules for the synthesis of a tone.

With this arrangement, the user can select a tone synthesis algorithm but can not program it, i.e., assemble a connected structure of the plurality of tone generator modules. Further, with the increase of the number of tone synthesis algorithms, it becomes difficult for the user to grasp the correspondence between numbers and tone synthesis algorithms.

Further, the tone generator used in the above system is basically of the frequency modulation (FM) type. Therefore, the output of a module is usable in only two alternatives, one for partial output of the tone generator, and the other for part of a phase signal input to the same or a different module.

U.S. patent application Ser. No. 002,121, filed on Jan. 12, 1987, concerning the assignee of this application discloses a tone generator with a plurality of TDM modules, which can utilize the output of each module in various ways, for instance, as part of a synthesized tone, an envelope input to a different module or part thereof or a phase input to a different module or part thereof. Therefore, the number Of tone synthesis algOrithms executable by the tone generator is extremely large and may readily exceed 100,000 for eight modules. The application, however, does not show any technique that permits the user to select or assemble a tone synthesis algorithm.

SUMMARY OF THE INVENTION

An object of the present invention is to provide an electronic musical instrument which allows the user to easily program a configuration of tone synthesis.

Another object of the invention is to provide an electronic musical instrument in which a tone generator can synthesize tones in various ways according to selected tone synthesis algorithms.

A further object of the invention is to provide an electronic musical instrument which permits the user to make the best use of the tone synthesis capacity of a tone generator having a plurality of time-division multiplexed modules.

In accordance with the present invention, there is provided an electronic musical instrument with a tone generator for synthesizing musical tones by using a plurality of time-division multiplexed waveform generator modules, which comprises input means for designating a connection structure of each pair of modules independently of the connection structures of other module pairs such that each module pair forms a tone synthesis unit, and processing means for generating control data for each module in response to the designation by the input means and for transferring the generated control data to the tone generator.

This arrangement has an advantage that the user can readily program a tone synthesis algorithm. Further, in contrast to the prior art, there is no need for the user to confirm the correspondence between numerical values and structures of a plurality of modules.

Preferably, the input means selects each module pair connection structure from:

(a) a mode in which the output of the first or former module in the pair is added to the output of the second or latter module in the pair;

(b) a mode in which the output of the former module is used as a phase signal to the latter module; and (c) a mode in which the output of the former module is used as part of an envelope signal to the latter module.

There may be further provided display means which visually displays a connected structure of a plurality of modules in response to the designation by the input means.

The electronic musical instrument may further comprise additional input means for independently designating a connection structure of each pair of the tone synthesis units.

With this addition, the number of programmable tone synthesis algorithms is further increased, permitting the user to take full advantage of the tone generator capacity.

Preferably, additional input means selects a connection structure of each pair of tone synthesis units from:

(a) a mode in which the output of the preceding tone synthesis unit in the pair is used as at least part of a phase signal to the latter module in the succeeding tone synthesis unit in the pair; and (b) a mode in which the output of the preceding tone synthesis unit in the pair is used as at least part of a tone to be output from the tone generator.

Module control data may contain phase distortion control data. In this relation, each module may include means for receiving a phase signal, means for modulating the received phase signal according to the phase distortion control data, sine wave memory means, means for accessing sine wave memory means by using the modulated phase signal, means for receiving an envelope signal and means for multiplying the received envelope signal by an output signal from the sine wave memory means.

The phase signal may be selected according to the module control data from a phase signal from basic parameter generator means, an output signal from the former module, an output signal of the previous tones synthesis unit and the sum of or difference between the output signal of the former module and the output signal from the previous tone synthesis unit. The envelope signal may be selected according to the module control data from an envelope signal from the basic parameter generator means and the sum of the output of the preceding module and the envelope signal from the basic parameter generator means.

BRIEF DESCRIPTION OF THE DRAWINGS

The above and other objects, features and advantages of the invention will become more apparent from the following detailed description with reference to the accompanying drawings, in which.

DETAILED DESCRIPTION OF PREFERRED EMBODIMENTS

Figure 1:
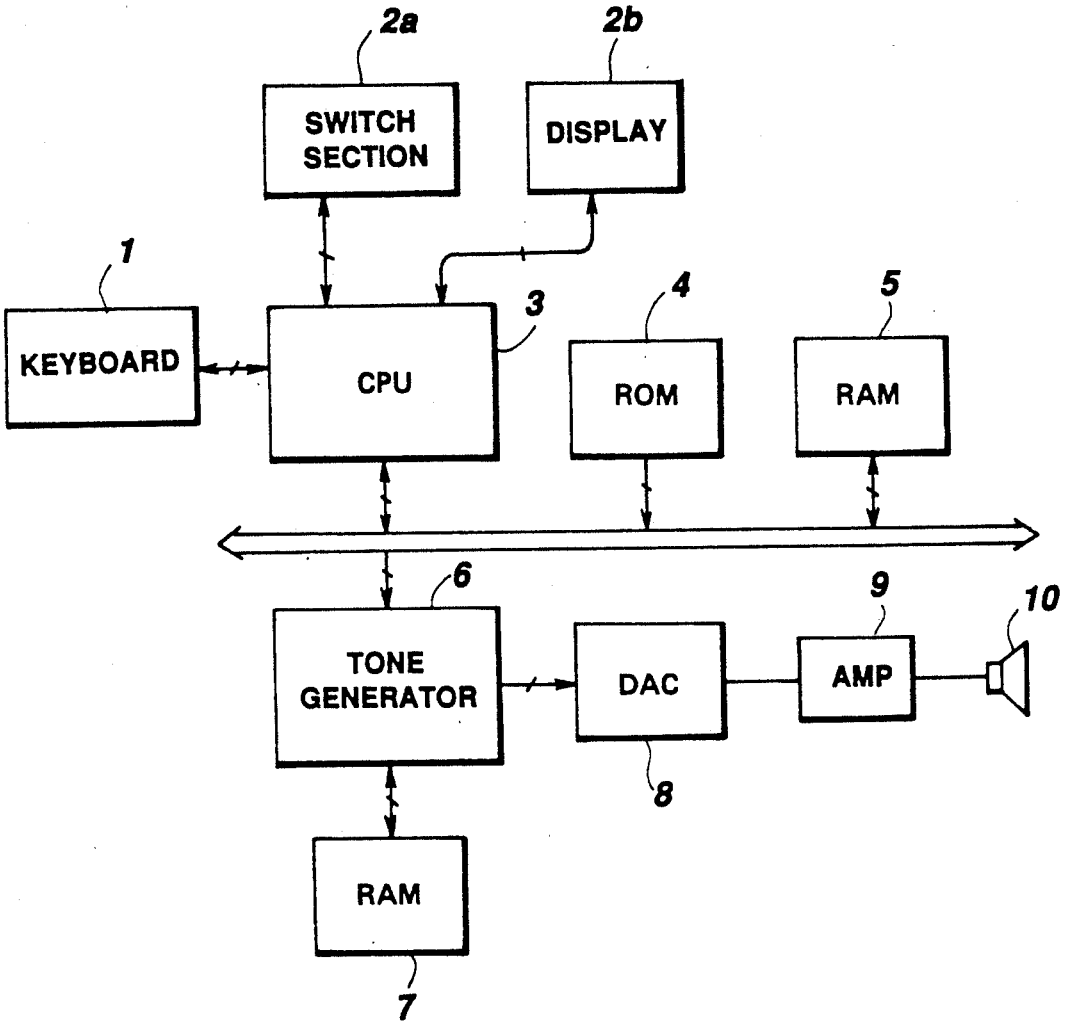
FIG. 1 is a block diagram of an electronic musical instrument in accordance with the invention.

Now, an embodiment of the invention will be described with reference to the drawings. FIG. 1 is a block diagram of an electronic musical instrument incorporating the features of the invention. The states of a keyboard 1 and a switch section 2*a*, are monitored by CPU 3 to detect key-"on", key-"off", tone color selection, etc. Data concerning the selected tone color, edit, etc. are presented on a display section 2*b* by CPU 3. For the control of a tone generator LSI 6, the CPU 3 generates the necessary data using a ROM 4 and a RAM 5 and transfers the generated data to the tone generator LSI 6. The tone generator 6 uses an external RAM 7 as an operation buffer to generate tones. The generated tones are converted by a digital-to-analog converter (DAC) into analog signals, which are amplified by an amplifier 9 and sounded by a loudspeaker 10.

Figure 2:
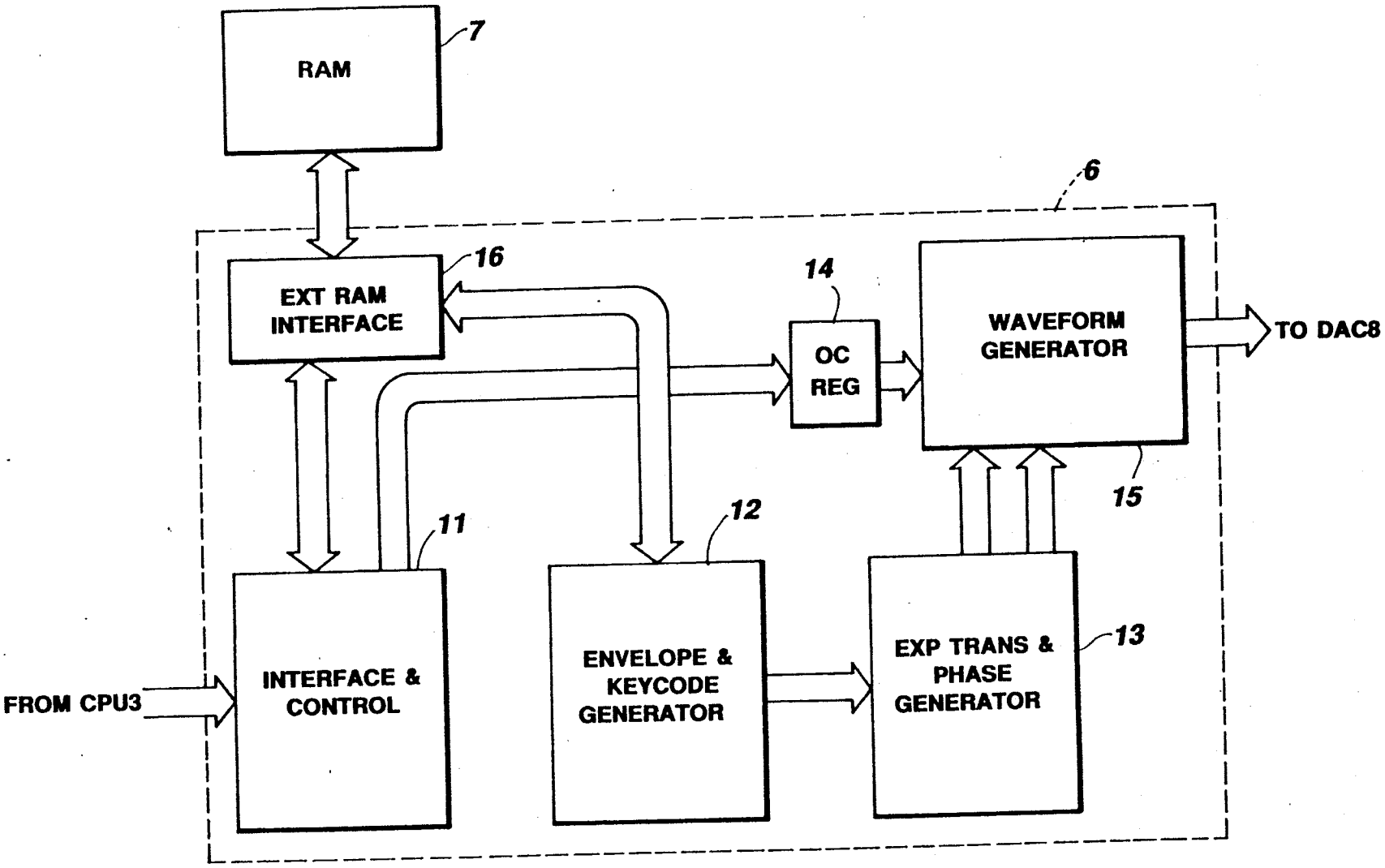
FIG. 2 is a block diagram of a tone generator LSI useful instrument.

FIG. 2 shows a block diagram of the tone generator LSI 6. In this example, the tone generator LSI 6 has an 8-channel structure having 8 modules per channel. An interface/controller 11 provides an interface between CPU 3 and the tone generator LSI 6. It generates timing signals used in various parts of the tone generator LSI 6. Also, it decodes the data transferred from the CPU 3 and writes the decoded data in the external RAM 7 through an external RAM interface 16. An envelope and keycode generator 12 reads and writes data from and in the external RAM 7 via the external RAM interface 16 and generates and supplies envelope and keycode data to an exponential transformation and phase angle generation unit 13. The unit 13 performs exponential transformation of the supplied envelope and keycode data and accumulates the transformed keycode data (differential value of the phase) to generate the phase angle data. In the present example, the envelope and keycode generator 12 samples envelope and keycode data at a relatively low rate because it uses the external RAM 7. On the other hand, the waveform generator 15 samples tones at a high rate. For this reason, the exponential transformation and phase generator unit 13 carries out the rate conversion using an internal buffer (not shown). As a result, the exponential transformation and phase angle generation circuit 13 supplies the phase angle and envelope data to the waveform generator 15 at each channel and module time, maintaining synchronization with the waveform generator 15. An OC register 14 includes a memory for storing data (operation codes) for controlling the operation of the waveform generator 15 for each channel and module. The memory is updated via the interface/controller 11 every time an operation code is transferred from CPU 3. At each channel and module time of the waveform generator 15, the OC register 14 reads out a corresponding operation code from the internal memory and supplies it to the waveform generator 15. The waveform generator 15 selectively uses time-division multiplexed envelope and phase angle data supplied from the exponential transformation and phase angle generation circuit 13 according to time-division multiplexed operation code data for each channel and module provided by the OC register 14 to generate various tones.

Figure 3:
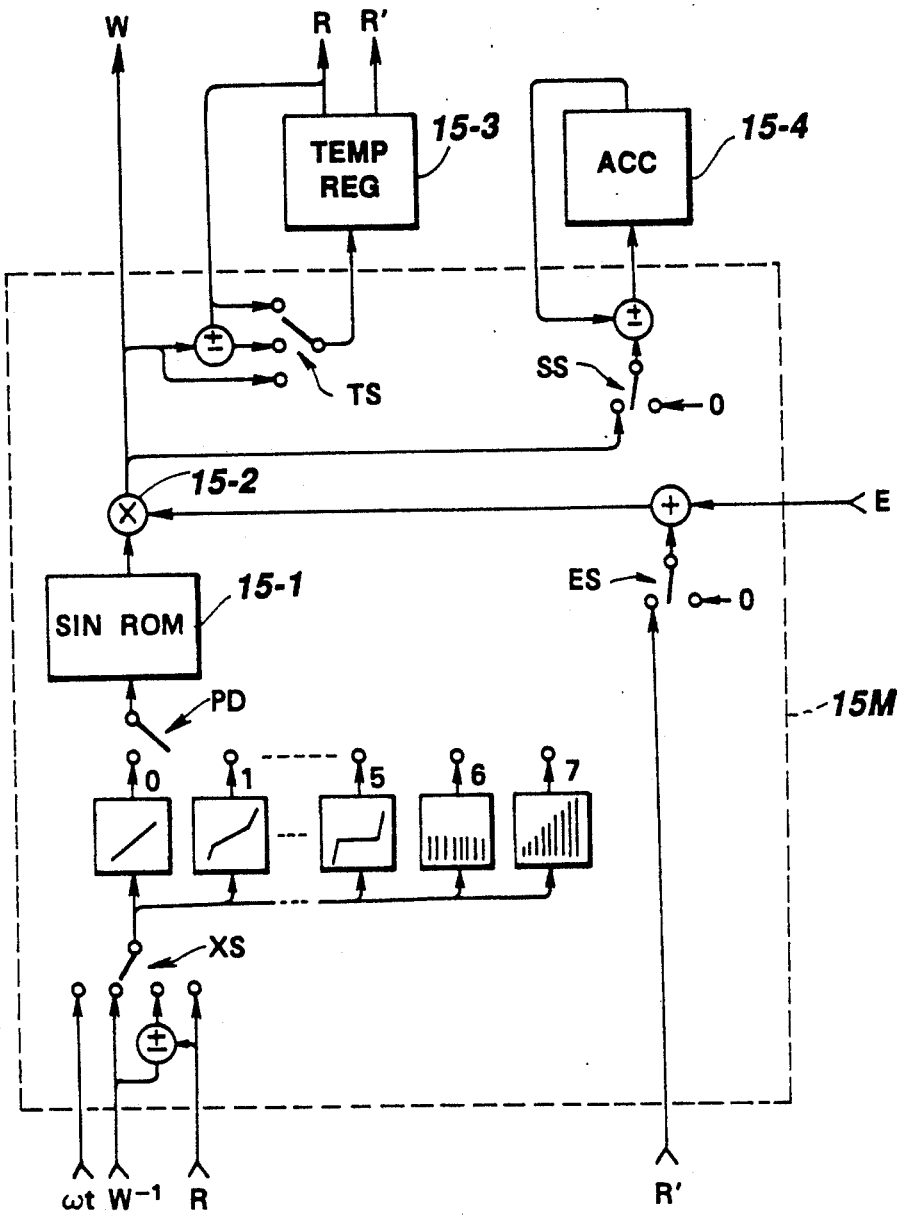
FIG. 3 shows logical arrangement of a waveform generator for use in the tone generator.

FIG. 3 illustrates a logical arrangement of the waveform generator 15. A portion surrounded by the dashed rectangle indicates a waveform generator module 15M which operates on TDM basis. In the Figure, labeled E and $\omega t$ are time-division multiplexed envelope data and phase angle data supplied by the exponential transformation and phase angle generation circuit 13 at each channel and module time. The states of selectors XS, ES, TS and SS in the waveform module 15M are each controlled by operation codes provided from the OC register 14 at each channel and module time. The selection circuit XS is for selecting a phase angle used in the waveform module 15M. The phase angle selector XS selects the phase angle according to the operation code from:

(a) phase angle data generated by the exponential transformation and phase angle generation circuit 13;

(b) waveform output $W_{-1}$ of an immediately preceding module;

(c) output R of temporary register 15-3; or (d) sum of or difference between (b) and (c).

Designated by ES is an envelope selection circuit which selects;

(a) envelope data E generated by the exponential transformation and phase angle generation circuit 13 when the bit 3 of the operation code OC is "0", and (b) the past or accumulated waveform R' from the temporary register 15-3 added to the envelope data E when the bit 3 of the operation code OC is "1".

Designated by PD is a phase distortion/noise selection circuit which selects:

(a) no phase distortion when the bits 2 to 0 of the operation code OC is "0", (b) five progressive phase distortions when the value of the bits 2 to 0 is "1" to "5", (c) white noise when the value of the bits 2 to 0 is "6", and (d) the product of white noise and sinusoidal wave, i.e., pink noise, when the value of the bits 2 to 0 is "7".

If no phase distortion is selected the waveform module 15M converts a phase selected by the phase angle selector XS into a sinusoidal wave at that phase using a SINROM 15-1 and multiplies it by an envelope selected by the envelope selector ES using a multiplier 15-2. The output of the multiplier defines the output W of the waveform module 15M.

TS is a circuit for selecting an input to the temporary register 15-3. TS selects the input according to the operation code from:

(a) waveform output W of the current module, (b) output R of the temporary register, or (c) sum of or difference between (a) and (b).

SS selects an input to an accumulator 15-4 which accumulates waveforms to form a tone to be supplied to DAC 8.

The input to the accumulator is either:

(a) the result of addition or subtraction of the waveform W of the current module to or from existing accumulated waveform, or (b) existing accumulated waveform (without change).

Thus, the accumulator input selector SS controls whether to use the waveform output W of the current module as part of a tone to be output from the waveform generator 15.

Figures 4, 5:
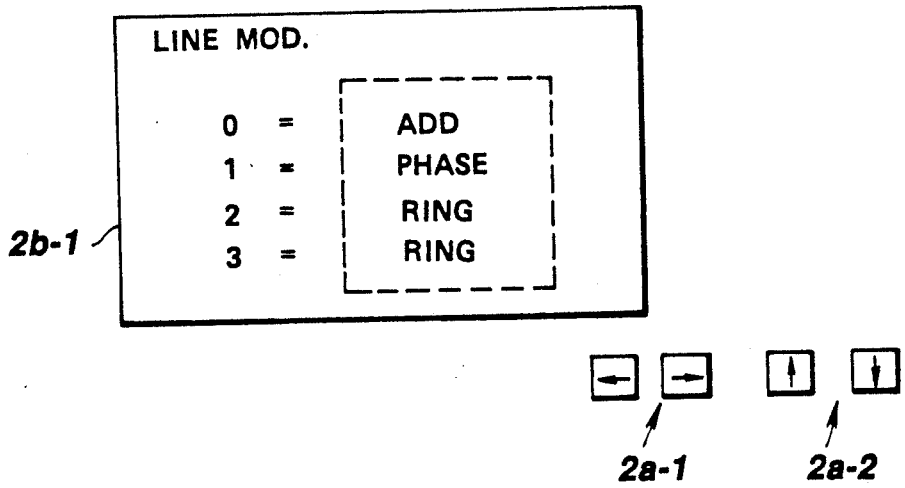
FIG. 4 shows correspondence between operation codes and operations of the waveform generator.
FIG. 5 is a view of an input unit in a first embodiment.

FIG. 4 shows correspondence between operation codes and operations of the waveform module 15M. A suffix 1 in the Figure indicates an ordinal module number. For example, when the operation code OC is 0X (hexadecimal notation), the input to the accumulator 15-4 is the sum of whatever is in the accumulator Σ and waveform output $W_{i-1}$ of the preceding module, while the phase angle input $X_1$ to the current module is given by the phase data $\omega_i t$ from the exponential transformation and phase angle generation circuit 13.

This invention concerns a technique of designating an operation mode of each TDM waveform module in a tone generator as exemplified by the waveform generator 15. By way of example, two embodiments will be described.

First Embodiment

In a first embodiment or design, a way of combining or interconnecting individual pairs of the modules can be designated using an input unit. There are three ways or modes of combination, i.e., addition mode, phase mode and ring modulation mode. Let $E_i \sin \omega_i t$, be the output waveform of module i. In the addition mode we obtain $$E_i \sin \omega_i t + E(i+1) \sin \omega(i+1)t.$$

In the phase mode, the output waveform of the module i constitutes the phase of the next module i+1, so we have $$E(i+1) \sin (E_i \sin \omega_i t).$$

In the ring modulation mode, the output waveform of module i is added to the envelope E(i+1) produced by the exponential transformation and angle generation circuit 13 to define an envelope used in the waveform module i+1. Thus, we obtain $$(E(i+1)1+E_i \sin \omega_i t) \sin \omega(i+1)t.$$

FIG. 5 shows an example of the input unit for designating the above three modes of combination. In the Figure, designated by 2b-1 is a display section. The waveform generator 15 synthesizes a tone using a total of eight modules. If two modules are called a line as a unit (tone synthesis unit), there are a total of four lines. The actual waveform generator 15 noted above can generate tones for eight channels each consisting of eight modules. The following description, however, assumes a single channel for the sake of brevity. Numerals 0 to 3 shown on the left side of the screen of the display 2b-1 represents line numbers. For example, line 0 is a combination of modules 0 and 1. The way of combining each pair of modules is displayed on the right side of the corresponding line number. A line is selected by a cursor key 2a-1, and the way of combination of the pair of modules (addition phase or ring modulation mode) is selected by a value key 2a-2. For example "ADD", in the Figure, means that modules 0 and 1 are added together. The display section 2b-1 is part of the display 2b shown in FIG. 1. The keys 2a-1 and 2a-2 form part of the switch section 2a.

Figure 6:
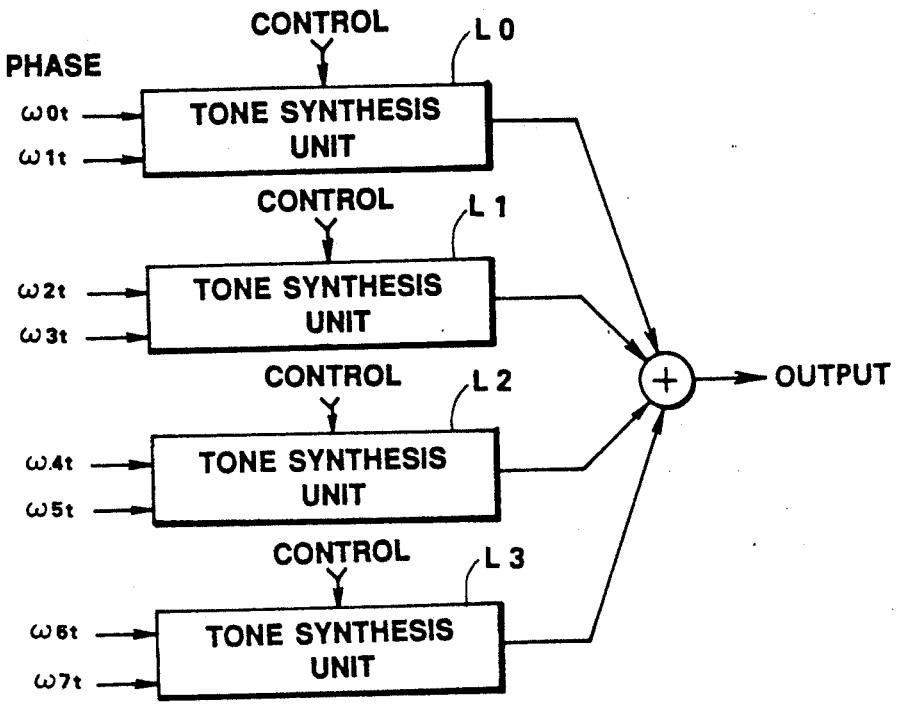
FIG. 6 is a schematic diagram of the waveform generator in the first design, showing respective tone synthesis units.

FIG. 6 schematically shows the waveform generator 15 when eight TDM modules of the waveform generator 15 are regarded as four tone synthesis units or lines $L_0$ to $L_3$.

Figure 7:
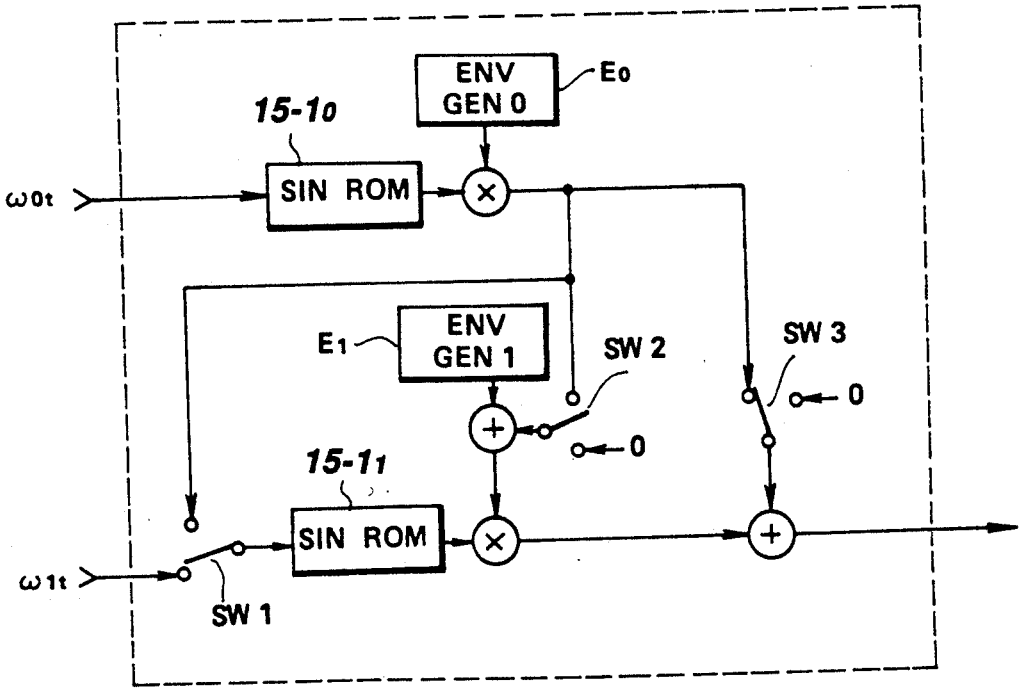
FIG. 7 is a schematic diagram of the first tone synthesis unit in FIG. 6.

FIG. 7 shows the first tone synthesis line $L_0$. The functions of the waveform generator 15 described in conjunction with FIG. 3 are shown here in a simplified form for the sake of explanation of the first design. For example, designated by 15-1$_0$ is SINROM 15-1 in the module 0, and 15-1$_1$ is SINROM 15-1 in the module 1. The output of $E_0$ is an envelope generated by the exponential transformation and phase angle generation circuit 13 (FIG. 2) at a time of module 0, and the output of $E_1$ is an envelope generated by the circuit 13 at a time of module 1. The other lines $L_1$ to $L_3$ are similarly arranged. The relation between the module 0 and 1 can be selected from three modes, i.e., "addition", "phase" and "ring modulation" modes, by means of three select switches SW1 to SW3 shown in the Figure.

Figures 8, 9:
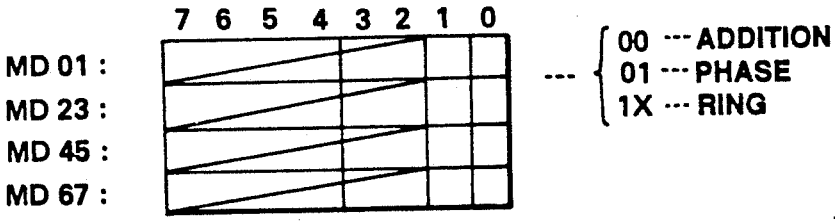
FIG. 8 shows correspondence between operation codes and respective modes of addition, phase and ring modulation of two consecutive modules.
FIG. 9 shows waveform synthesis registers storing instructions of tone synthesis provided by the input unit shown in FIG. 5.

FIG. 8 shows correspondence between two operation codes OC0 and OC1 for the respective modules 0 and 1 and the select switches SW1 to SW3 in FIG. 7. OC0 and OC1 on the first row state that the two modules be added. In the case of OC0 and OC1 on the second row, the output of the preceding module (module 0) becomes the phase of the succeeding module (module 1). OC0 and OC1 on the third row indicates the ring modulation.

FIG. 9 shows waveform synthesis registers MD01, MD23, MD45 and MD67 set by the input unit shown in FIG. 5. These registers are provided in the RAM 5 shown in FIG. 1. The lowest two bits of each register specifies the relation between two modules. The CPU 3 in FIG. 1 generates each operation code from the contents of each register and transfers it to the OC register 14 of the tone generator LSI 6.

Figure 10:
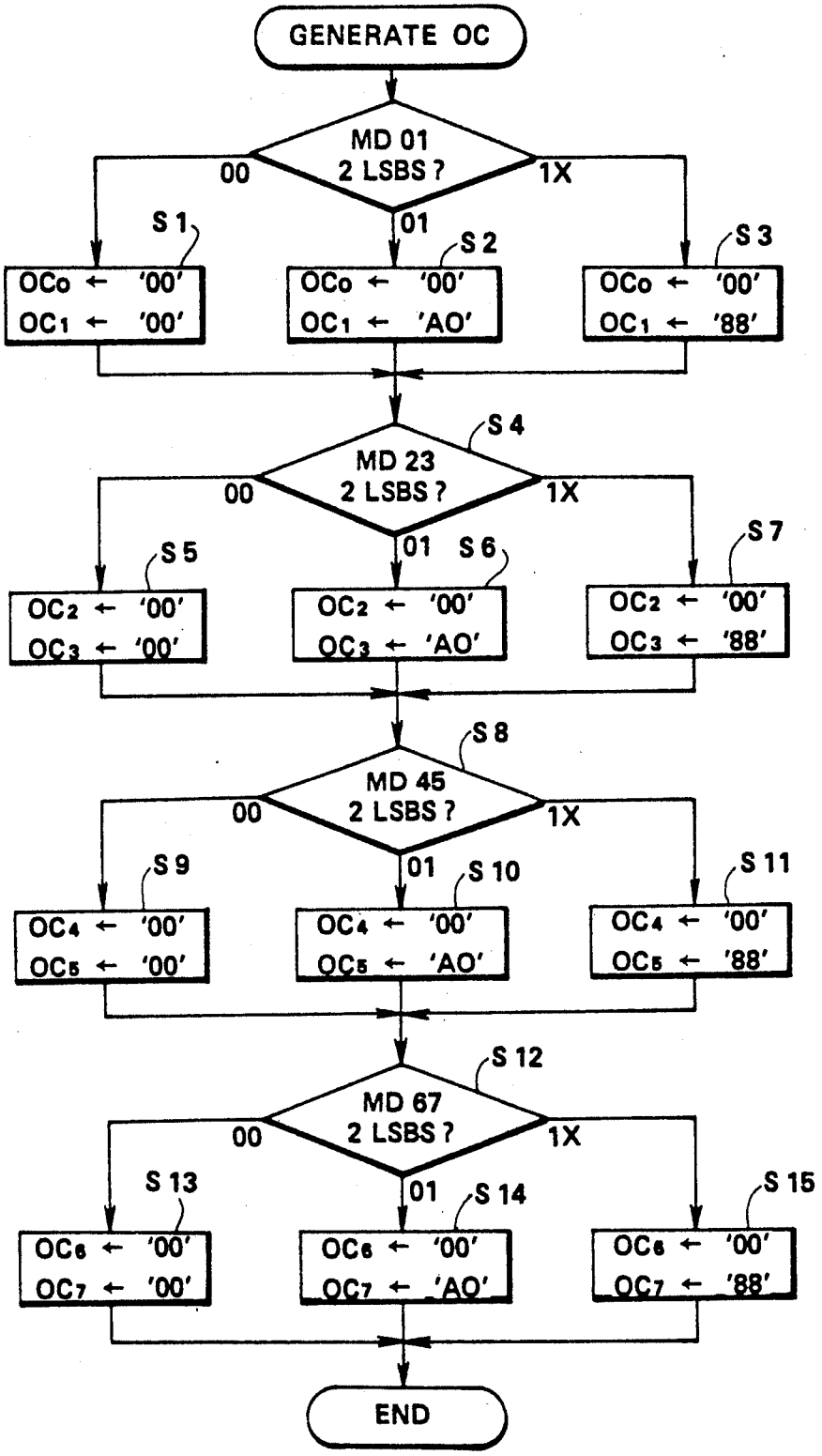
FIG. 10 is a flow chart for generating operation codes for the waveform generator from the contents of the waveform synthesis registers.

FIG. 10 shows a flow chart of generating operation codes OC as done by CPU 3. The CPU 3 checks the lowest two bits of each of the registers MD01, MD23, MD45 and MD67 in the steps S0, S4, S8 and S12. If the lowest two bits are "00" representing an addition, the CPU makes the operation code for the preceding module equal to "00" and the operation code for the succeeding module equal to "00" (steps S1, S5, S9 and S13). As is seen from FIGS. 4 and 8, with this combination of operation codes, the waveform generator 15 executes addition of two modules. When the lowest two bits are "01" representing a phase operation, the operation codes of the preceding and succeeding modules are respectively "00" and "A0" (steps S2, S6, S10 and S14). As a result, the waveform generator 15 selects the output of the preceding module as the phase input to the succeeding module. When the lowest two bits are "1X" (where X is a "don't care" bit) representing a ring modulation operation the operation codes of the preceding and succeeding modules are respectively "00" and "88" (S3, S7, S11 and S15). As a result, the envelope used in the succeeding module i+1 is given by $$(E_{(i+1)}+E_i)\sin \omega_i t$$

and the ring modulation is achieved.

Since there are three different ways of combining two modules, a total of eight modules reside in the tone generator, and each tone synthesis line is independent of the others, there are a total of $3^4$ i.e., eighty one possible tone synthesis combinations.

In this manner, the first embodiment regards the eight TDM waveform modules provided in the waveform generator 15 as four different pairs of modules, and allows the connection structure of each module pair (line) to be selected using the input unit.

Second Embodiment

A second embodiment or design allows, in addition to the requirements of the first design, the waveform output of the current line to be used as either (a) a phase input to the latter module of the next line or part of the input, or (b) a tone.

By adding the selection (a), the module phase input may contain a plurality of frequency components, thus enriching tones generated.

Figure 11:
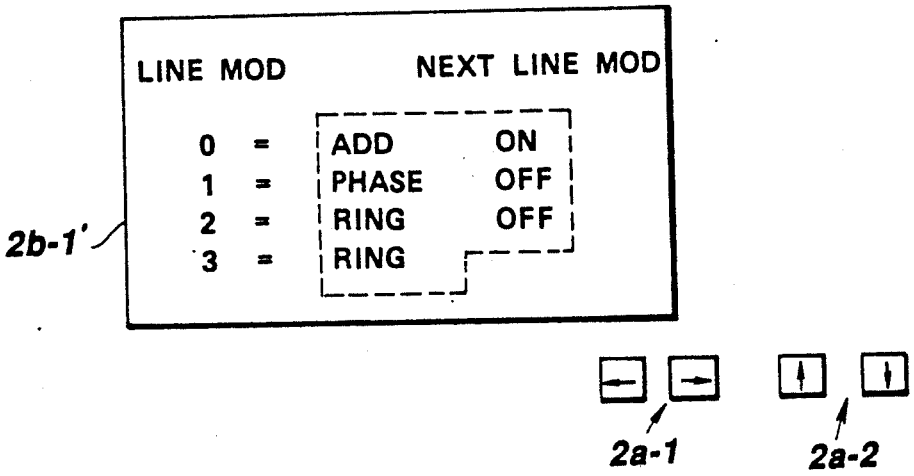
FIG. 11 is a view of an input unit in a second embodiment.

FIG. 11 shows an input unit for use in the second design. As is seen from the screen of a display section **2*b*-1, it is possible to select both the relation of two modules constituting a line (i.e., either addition, phase or ring modulation) and the relation of the current line with the next. "ON" shows that the current line output is supplied to the input of the next line. "OFF" shows that the line output is not supplied as the input to the next line but is used as a tone. A cursor key 2*a*-1 selects a line number, or a value key 2*b*-1** selects the line-setting data.

Figure 12:
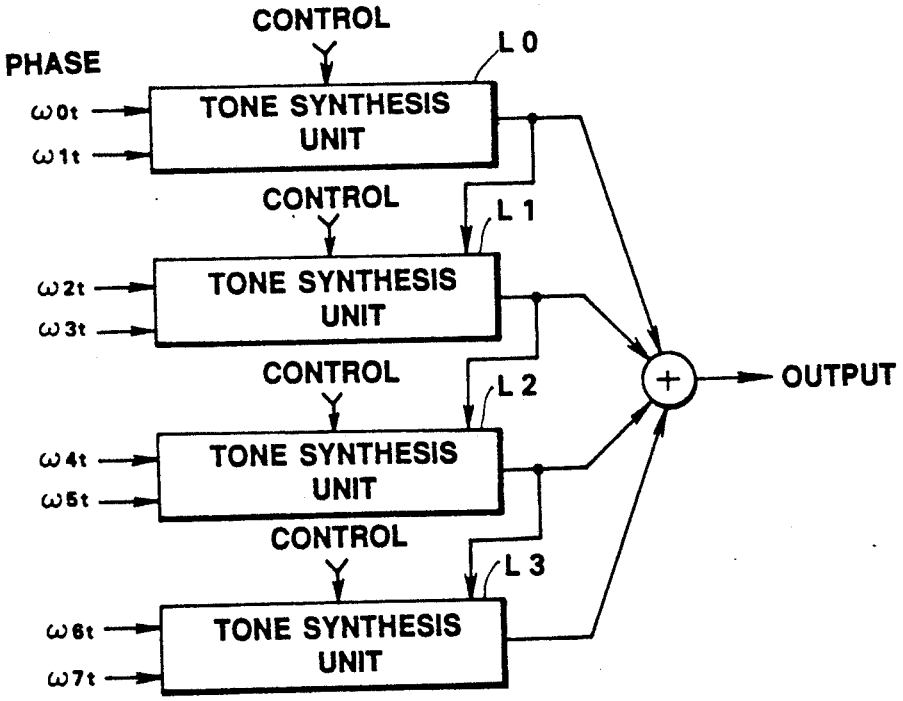
FIG. 12 is a schematic diagram of the waveform generator in the second embodiment, showing respective tone synthesis units.

FIG. 12 schematically shows the waveform generator 15 in the second design. The second design is the same as the first insofar as two consecutive modules are regarded as a single tone synthesis line but is different in that each line output can be input to the next line.

Figure 13:
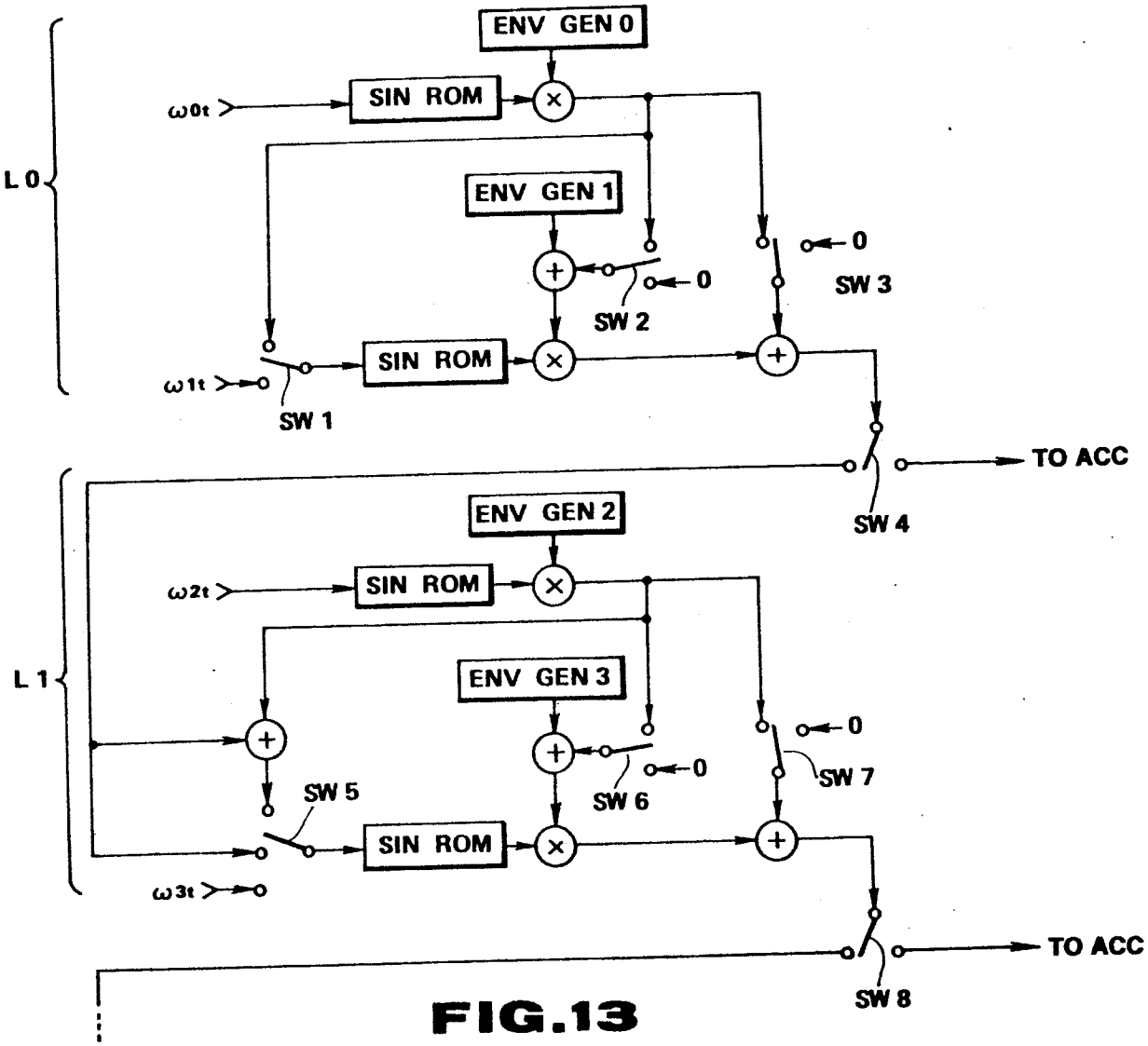
FIG. 13 is a schematic diagram of first two units in FIG. 12.

FIG. 13 shows an arrangement of the first and second tone synthesis line $L_0$ and $L_1$ in FIG. 12.

Select switches SW1 to SW 3 in the unit $L_0$ and select switches SW5 to SW7 in the unit $L_1$ serve to select module relation in each line from the addition, phase and ring modulation modes. Select switches SW4 and SW8, which are additionally provided in the second design, determine whether the line output is supplied to the next line or used as a tone.

In FIG. 13, if the select switch SW4 has its pole thrown to the left, the output $\alpha_0$ of the line $L_0$ is supplied to the next line $L_1$. The line $L_1$ provides $$E_3 \sin(\alpha_0)+E_2 \sin \omega_2 t,$$

$$E_3 \sin(\alpha_0+E_2 \sin \omega_2 t), \text{ and}$$

$$(E_3+E_2 \sin \omega_2 t) \sin(\alpha_0)$$

when the switches SW5, SW6 and SW7 are in the center, lower and left positions, in the upper, lower and right positions and in the center, upper and right positions, respectively. Generally, when the output $\alpha_{i/2\text{-}1}$ of the line i/2-1 is supplied to the next line 1/2, the output of the latter is either $$E(i+1) \sin(\alpha_{i/2\text{-}1})+E_i \sin \omega_i t,$$

$$E(i+1) \sin(\alpha_{i/2\text{-}1}+E_i \sin \omega_i t), \text{ or}$$

$$(E(i+1)+E_i \sin \omega_i t) \sin(\alpha_{i/2\text{-}1}).$$

Figures 14, 15:
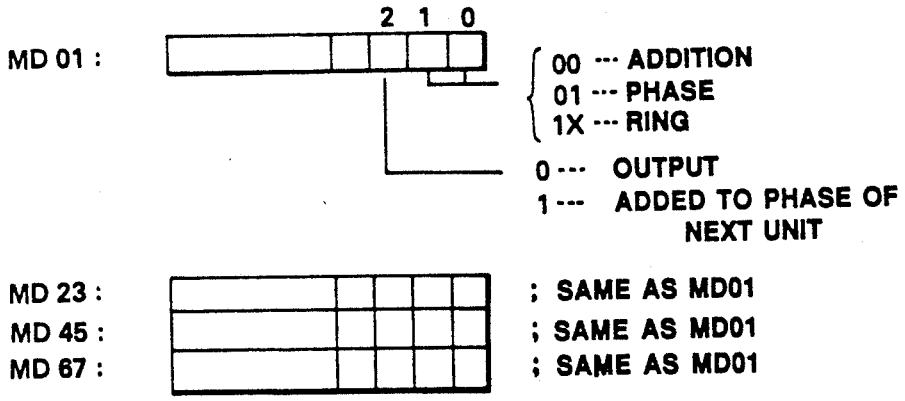
FIG. 14 shows correspondence between operation codes and the respective positions of the select switches in FIG. 13.
FIG. 15 shows waveform synthesis registers storing instructions of tone synthesis provided by the input unit shown in FIG. 11.

FIG. 14 shows correspondence between operation codes and positions of select switches SW1 to SW8. For example, when OC0="00", OC1="80", OC2="40" and OC3="10" as seen in the first row, the output of the first line $L_0$ is $$E_0 \sin \omega_0 t+E_1 \sin \omega_1 t.$$

This output constitutes the phase input to the second line $L_1$. The module 3 of $L_1$ provides $$E_3 \sin(E_0 \sin \omega_0 t+E_1 \sin \omega_1 t).$$

This output is added to the output $E_2 \sin \omega_2 t$ of the module 2 of the line $L_1$. More specifically, this is read from FIGS. 3 and 4. With OC="00" a waveform $E_0 \sin \omega_0 t$ is generated by the module 0. This is supplied to the temporary register 15-3 in FIG. 3 ($R=E_0 \sin \omega_0 t$) with OC1="80". Further, with OC1="80" a waveform $E_1 \sin \omega_1 t$ is generated by the module 1, and with OC2="40" this waveform is added to the previous $E_0 \sin \omega_0 t$, the sum being supplied to the temporary register 15-3 ($R=E_0 \sin \omega_0 t+E_1 \sin \omega_1 t$). Further, with OC2="40" a waveform $E_2 \sin \omega_2 t$ is generated by the module 2, and with OC3="10" the content $E_0 \sin \omega_0 t+E_1 \sin \omega_1 t$ of the temporary resister 15-3 is supplied as phase input to the module 3. The module 3 provides an output $E_3 \sin(E_0 \sin \omega_0 t+E_1 \sin \omega_1 t)$, and with OC3="10" the waveform $E_2 \sin \omega_2 t$ from the module 2 is supplied to the accumulator 15-4 ($\Sigma=E_2 \sin \omega_2 t$). Although not shown in FIG. 14, the operation code OC4 of the next module is "00" (see FIG. 16 to be described later). Thus, the output of the module 3 is added to the waveform of the preceding module 2 and supplied to the accumulator 15-4 ($\Sigma=E_2 \sin \omega_2 t+E_3 \sin(E_0 \sin \omega_0 t+E_1 \sin \omega_1 t)$.

FIG. 15 shows waveform synthesis registers MD01, MD23, MD45 and MD67 which are altered by the input unit shown in FIG. 11. As in the first design, each lowest two bits designate the relation of two modules forming a line. Each bit 2 serves to determine whether the line output is to be provided as phase input to the next line or a tone. The CPU 3 generates operation codes for respective modules from these waveform synthesis registers MD01, MD23, MD45 and MD67 and transfers these codes to the OC register 14 of the tone generator.

Figure 16:
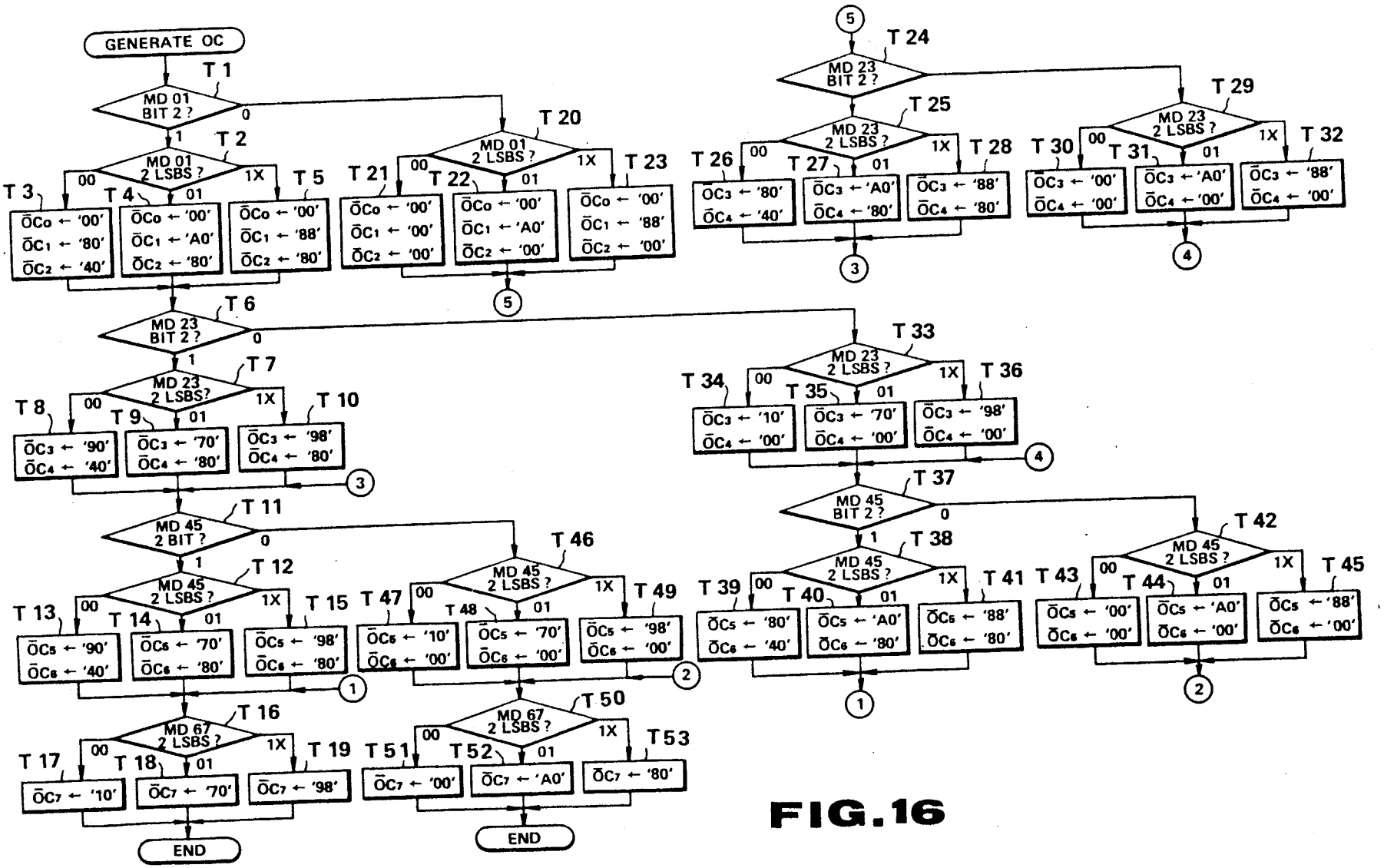
FIG. 16 is a flow chart for generating operation codes for the waveform generator from the contents of the waveform synthesis registers shown in FIG. 15.

FIG. 16 is a flow chart of generating operation codes as is done by the CPU 3. This will now be described in conjunction with some examples of tone synthesis.

The synthesis of $E_2 \sin \omega_2 t + E_3 \sin (E_0 \sin \omega_0 t + E_1 \sin \omega_1 t)$ has been described. In this case, MD01="04", and MD23="00". In the routine, OC0="00", OC1="80", OC2="40", OC3="10" and OC4="00" are generated through steps T1, T2, T3, T6, T33 and T34.

Now, synthesis of $E_3 \sin (E_2 \sin \omega_2 t + E_1 \sin \omega_1 t + E_0 \sin \omega_0 t)$ will be considered. In this case, MD01="40", and MD23="01". According to the routine, OC0="00", OC1 ="80", OC2="40", OC3="70" and OC4="00" are generated (steps T1, T2, T3, T6, T33 and T35). The synthesis operation is the same as the first example up to OC2. In the next OC3, the phase input $X_3$ receives $$W_2 + R = E_2 \sin \omega_2 t + E_1 \sin \omega_1 t + E_0 \sin \omega_0 t.$$

Thus, the output $W_3$ of the module 3 is given by $$E_3 \sin (E_2 \sin \omega_2 t + E_1 \sin \omega_1 t + E_0 \sin \omega_0 t).$$

This is supplied to the accumulator with the next operation code OC4="00" stating $$\Sigma = \Sigma + W_3.$$

Now, the synthesis of $(E_3 + E_2 \sin \omega_2 t) \sin (E_1 \sin \omega_1 t + E_0 \sin \omega_0 t)$ will be considered. In this case, MD01="04", and MD23="02". The routine generates OC0="00", OC1="80", OC2="40", OC3="98" and OC4="00" (steps T1, T2, T3, T6, T33 and T36). This example is the same as the preceding examples up to OC2. With OC3="98", the output $R$ $(= E_1 \sin \omega_1 t + E_0 \sin \omega_0 t)$ of the temporary register 15-3 is selected as the phase input $X_3$ to the module 3, and $E_3 + R'$ $(R' = W_2 = E_2 \sin \omega_2 t)$ is selected as the envelope input. The module 3 provides $(E_3 + E_2 \sin \omega_2 t) \sin (E_1 \sin \omega_1 t + E_0 \sin \omega_0 t)$ which is then supplied to the accumulator 15-4 with OC4.

Now, when providing $E_3 \sin (E_2 \sin \omega_2 t + E_1 \sin (E_0 \sin \omega_0 t))$, MD01="05" and MD23="01". Thus, the routine generates OC0="00", OC1="A0", OC2="80", OC3="70" and OC4="00" (steps T1, T2, T4, T6, T33 and T35). Up to OC2 this example is the same as the preceding examples. With OC3

$$X_3 \leftarrow R + W_2$$

is executed, and with OC4

$$\Sigma \leftarrow \Sigma + W_3$$

is executed, to obtain $$W_3 = E_3 \sin (W_2 + R) = E_3 \sin (E_2 \sin \omega_2 t + E_1 \sin (E_0 \sin \omega_0 t))$$

When providing $(E_3 + E_2 \sin \omega_2 t) \sin (E_1 \sin (E_0 \sin \omega_0 t))$, MD01="05" and MD23="02". Thus, OC0="00", OC1 ="A0", OC2="80", OC3="98" and OC4="00" are generated in the routine (steps T1, T2, T4, T6, T33 and T36). This example is the same as the preceding examples up to OC2. With OC3

$$X_3 \leftarrow R (= E_1 \sin (E_0 \sin \omega_0 t)).$$

Then, $$R' \leftarrow W_2 (= E_2 \sin \omega_2 t)$$

and then $$W_3 \leftarrow (E_3 + R') \sin X_3$$

are executed. With OC4

$$\Sigma \leftarrow \Sigma + W_3$$

is executed. Here we have $$W_3 = (E_3 + E_2 \sin \omega_2 t) \sin (E_1 \sin (E_0 \sin \omega_0 t)).$$

In any of the first three examples, the line $L_0$ performs addition, and in the latter two examples the line $L_0$ uses the module 0 output as the phase to the module 1. When the line L0 is in the ring modulation mode, MD01="06"; and OC0="00", OC1="88" and OC2="80" (step T4). With OC0

$$X_0 \leftarrow \omega_0 t$$

is executive, and with OC1

$$X_1 \leftarrow \omega_1 t,$$

$$R \leftarrow W_0 (E_0 \sin X_0 = E_0 \sin \omega_0 t) \text{ and}$$

$$W_1 \leftarrow (E_1 + R) \sin X_1$$

are executed. Thus, we have $$W_1 = (E_1 + E_0 \sin \omega_0 t) \sin \omega_1 t.$$

This is then stored in R with OC2. Thereafter, the line $L_1$ is designated in the same way as in the above examples. Thus, R i, e., contents of the temporary register 15-3 are used in one of the following:

$$E_3 \sin R + E_2 \sin \omega_2 t,$$

$$E_3 \sin (R + E_2 \sin \omega_2 t) \text{ or}$$

$$(E_3 + E_2 \sin \omega_2 t) \sin R.$$

For example, when synthesizing $E_7 \sin (E_5 \sin (E_3 \sin (E_1 \sin \omega_1 + E_0 \sin \omega_0 t) + E_2 \sin \omega_2 t) + E_4 \sin \omega_4 t) + E_6 \sin \omega_6 t$, MD01="04", MD23="04", MD45="04" and MD67="00". In the routine, OC0="00", OC1="80", OC2="40", OC3="90", OC4="40", OC5="90", OC6="40" and OC7="10" are generated as the operation codes (step T1, T2, T3, T6, T7, T8, T11, T12, T13, T16 and T17). Using suffix as module numbers of waveform generator 15M, respective functions of OC0 to $$\text{OC0: } \Sigma \leftarrow W_7 + \Sigma,\ X_0 \leftarrow \omega_0 t$$

OC1: $R_1 \leftarrow W_0,\ X_1 \leftarrow \omega_1 t$

OC2: $R_2 \leftarrow W_1 + R_1,\ X_2 \leftarrow \omega_2 t$

OC3: $R_3 \leftarrow W_2,\ X_3 \leftarrow R_2$

OC4: $R_4 \leftarrow W_3 + R_3,\ X_4 \leftarrow \omega_4 t$

OC5: $R_5 \leftarrow W_4,\ X_5 \leftarrow R_4$

OC6: $R_6 \leftarrow W_5 + R_5,\ X_6 \leftarrow \omega_6 t$

OC7: $\Sigma \leftarrow W_6,\ X_7 \leftarrow R_6$

The final contents $\Sigma$ of the accumulator 15-4 are $\Sigma = W_7 + W_6 = E_7 \sin X_7 + E_6 \sin X_6 = E_7 \sin R_6 + E_6 \sin \omega_6 t$. Here, $$R_6 = W_5 + R_5 = E_5 \sin X_5 + W_4 = E_5 \sin R_4 + E_4 \sin \omega_4 t,$$

where $$R_4 = W_3 + R_3 = E_3 \sin X_3 + W_2 = E_3 \sin R_2 + E_2 \sin \omega_2 t,$$

where $$R_2 = W_1 + R_1 = E_1 \sin X_1 + W_0 = E_1 \sin \omega_1 t + E_0 \sin X_0 = E_1 \sin \omega_1 t + E_0 \sin \omega_0 t.$$

Therefore, the final output is $$E_7 \sin (E_5 \sin (E_3 \sin (E_1 \sin \omega_1 t + E_0 \sin \omega_0 t) + E_2 \sin \omega_2 t) + E_4 \sin \omega_4 t) + E_6 \sin \omega_6 t.$$

As has been shown, in the second design either the addition, phase or ring modulation mode can be selected for each module pair or line. It is also possible to make a selection as to whether the result of each line is used as the phase or partial phase input to the latter module of the next line or provided as a tone. The waveform generator 15 operates a total of eight TDM modules, so that $3^4 * 2^3 = 648$ different tone synthesis combinations are possible.

While preferred embodiments of the invention have been described, various changes and modifications are obvious to a person having an ordinary skill in the art without departing from the scope of invention. For example, the display unit may provide a graphic representation of the connection structure of a plurality of modules. Thus, the scope of the invention should be defined solely by the appended claims.

What is claimed is:

1. An electronic musical instrument, comprising:

a tone generator for synthesizing musical tones, said tone generator including a plurality of waveform generation modules and means for time-division multiplexing the operation of said modules;

said tone generator also including means for connecting said waveform generator modules to one another in a selected one of a plurality of all possible connection configuration of individual pairs of said modules;

input means for inputting module-pairing data for constructing a connection configuration selected from said plurality of all possible configurations of each pair of said plurality of modules, for said each pair of said plurality of modules independently of connection configurations of the other module pairs such that each module pair forms a tone synthesis unit, the synthesis operation of which is determined by said module-pairing data; and processing means for converting said module-pairing data inputted by said input means, into control data that is compatible with the connecting means of said tone generator and with each of said modules, and for transferring the control data to said tone generator.

2. The electronic musical instrument according to claim 1, further comprising display means for visually displaying the connection configuration of the plurality of modules according to the module-pairing data inputted by said input means.

3. An electronic musical instrument, comprising:

a tone generator for synthesizing musical tones, said tone generator including a plurality of waveform generation modules and means for time-division multiplexing the operation of said modules;

input means for inputting module-pairing data for designating a desired connection configuration from a plurality of possible configurations for each pair of said plurality of modules independently of connection configurations of the other module pairs such that each module pair forms a tone synthesis unit, the synthesis operation of which is determined by said module-pairing data; and processing means for converting said module pairing data inputted by said input means, into control data that is compatible with said tone generator and with each of said modules, and for transferring the control data to said tone generator;

wherein said input means includes means for selecting said module pair connection configuration from:

(a) a mode in which the output of a first module in the pair is added to the output of a second module in the pair;

(b) a mode in which the output of the first module of the pair is used as a phase signal to the second module in the pair; or (c) a mode in which the output of the first module in the pair is used as part of an envelope signal to the second module in the pair.

4. An electronic musical instrument, according;

a tone generator for synthesizing musical tones, said tone generator including a plurality of waveform generation modules and means for time-division multiplexing the operation of said modules;

input means for inputting module-pairing data for designating a desired connection configuration from a plurality of possible configuration for each pair of said plurality of modules independently of connection configuration of the other module pairs such that each module pair forms a tone synthesis unit, the synthesis operation of which is determined by said module-pairing data; and processing means for converting said module pairing data inputted by said input means, into control data that is compatible with said tone generator and with each of said modules, and for transferring the control data to said tone generator; and in which said control data contains phase distortion control data, and each module includes means for receiving a phase signal, means for modulating the received phase signal according to the phase distortion control data, sine wave memory means, means for accessing said sine wave memory means by using the modulated phase signal, means for receiving an envelope signal and means for multiplying the received envelope signal by the output signal from said sine wave memory means.

5. An electronic musical instrument, comprising:

a tone generator for synthesizing tones, said tone generator including a plurality of waveform generation modules and means for time-division multiplexing the operation of said modules;

first input means for inputting module-pairing data for designating a desired connection configuration from a plurality of possible configurations for each pair of said plurality of modules independently of connection configurations of the other module pairs such that each pair forms a tone synthesis unit, the synthesis operation of which is determined by said module-pairing data;

second input means for inputting unit-pairing data for designating a connection configuration of each pair of tone synthesis units independently of connection configurations of the other unit pairs; and processing means for converting said module-pairing data inputted by said first input means and said unit-pairing data input by said second input means, into control data that is compatible with said tone generator means and with each module, and for transferring the control data to said tone generator.

6. The electronic musical instrument according to claim 5, wherein said first input means includes means for selecting a connection configuration of each module pair from:

(a) a mode in which the output of a first module in the pair is added to the output of a second module in the pair;

(b) a mode in which the output of the first module in the pair is used as a phase signal to the second module in the pair; or (c) a mode in which the output of the first module in the pair is used as part of an envelope signal to the second module in the pair; and said second input means includes means for selecting a connection configuration of each pair of said tone synthesis units from:

(a) a mode in which the output of a first tone synthesis unit in the unit pair is utilized as at least part of a phase signal to the second module of a second tone synthesis unit in the unit pair; or (b) a mode in which the output of the first tone synthesis unit in the unit pair is used as at least part of a tone output from said tone generator.

7. The electronic musical instrument according to claim 5, further comprising display means for visually displaying the connection configuration of the plurality of modules according to the module-pairing data and the unit-pairing data inputted by the first and the second input means.

8. The electronic musical instrument according to claim 5, wherein said tone generator includes basic parameter generation means for generating phase signals and envelope signals each to be supplied to each module, and each module includes:

a first phase input port for receiving a phase signal from said basic parameter generation means;

a second phase input port for receiving an output signal from the first module;

a third phase input port for receiving an output signal from the first tone synthesis unit;

a fourth phase input port for receiving the sum of or difference between the output signal of the first module and output signal of the first tone synthesis unit;

phase selection means for selecting one of the first to fourth phase input ports according to said control data;

waveform generation means for generating a waveform signal by using a phase signal selected by said phase selection means;

a first envelope input port for receiving an envelope signal from said basic parameter generation means;

a second envelope input port for receiving the sum of the output signal of said first module and the envelope signal from said basic parameter generation means;

envelope selection means for selecting one of the first and second envelope input ports according to said control data; and means for multiplying the generated waveform signal by the selected envelope signal to form a module output signal.

9. An electronic musical instrument, comprising:

a tone generator for synthesis musical tones, said tone generator including waveform generation circuitry and means for time-division multiplexing said waveform generation circuitry into a plurality of modules;

said tone generator also including means for connecting said waveform generator modules to one another in a selected one of a plurality of all possible connection configurations of individual pairs of said modules;

input means for inputting module-pairing data for constructing a connection configuration selected from said plurality of all possible configurations of each pair of said plurality of modules, for said pair of said plurality of modules independently of connection configurations of the other module pairs such that each module pair forms a tone synthesis unit, the synthesis operation of which is determined by said module-pairing data; and processing means for converting said module-pairing data inputted by said input means, into control data that is compatible with the connecting means of said tone generator and with each of said modules, and for transferring the control data to said tone generator.

10. The electronic musical instrument according to claim 9, further comprising display means for visually displaying the connection configuration of the plurality of modules according to the module-pairing data inputted by said input means.

11. An electronic musical instrument, comprising;

a tone generator for synthesizing musical tones, said tone generator including waveform generation circuitry and means for time-division multiplexing said waveform generation circuitry into a plurality of modules;

input means for inputting module-pairing data for designating a desired connection configuration from a plurality of possible configurations for each pair of said plurality of modules independently of connection configurations of the other module pairs such that each module pair forms a tone synthesis unit, the synthesis operation of which is determined by said module-pairing data; and processing means for converting said module-pairing data inputted by said input means, into control data that is compatible with said tone generator and with each of said modules, and for transferring the control data to said tone generator;

wherein said input means includes means for selecting said module pair connection configuration from:

(a) a mode in which the output of a first module in the pair is added to the output of a second module in the pair;

(b) a mode in which the output of the first module in the pair is used as a phase signal to the second module in the pair; or (c) a mode in which the output of the first module in the pair is used as part of an envelope signal to the second module in the pair.

12. An electronic musical instrument, comprising;

a tone generator for synthesizing musical tones, said tone generator including waveform generation circuitry and means for time-division multiplexing said waveform generation circuitry into a plurality of modules;

input means for inputting module-pairing data for designating a desired connection configuration from a plurality of possible configurations for each pair of said plurality of modules independently of connection configurations of the other module pairs such that each module pair forms a tone synthesis unit, the synthesis operation of which is determined by said module-pairing data; and processing means for converting said module-pairing data inputted by said input means, into control data that is compatible with said tone generator and with each of said modules, and for transferring the control data to said tone generator; and in which said control data contains phase distortion control data, and each module includes means for receiving a phase signal, means for modulating the received phase signal according to the phase distortion control data, sine wave memory means, means for accessing said sine wave memory means by using the modulated phase signal, means for receiving an envelope signal and means for multiplying the received envelope signal by the output signal from said sine wave memory means.

13. An electronic musical instrument, comprising:

a tone generator for synthesizing tones, said tone generator including waveform generation circuitry and means for time-division multiplexing said waveform generation circuitry into a plurality of modules;

first input means for inputting module-pairing data for designating a desired connection configuration from a plurality of possible configurations for each pair of said plurality of modules independently of connection configurations of the other module pairs such that each module pair forms a tone synthesis unit, the synthesis operation of which is determined by said module-pairing data;

second input means for inputting unit-pairing data for designating a connection configuration of each pair of tone synthesis units independently of connection configurations of the other units independently of connection configurations of the other unit pairs; and processing means for converting said module-pairing data inputted by said first input means and said unit-pairing data input by said second input means, into control data that is compatible with said tone generator means and with each module, and for transferring the control data to said tone generator.

14. The electronic musical instrument according to claim 13, wherein said first input means includes means for selecting a connection configuration of each module pair from:

(a) a mode in which the output of a first module in the pair is added to the output of a second module in the pair;

(b) a mode in which the output of the first module in the pair is used as a phase signal to the second module in the pair; or (c) a mode in which the output of the first module in the pair is used as part of an envelope signal to the second module in the pair; and said second input means includes means for selecting a connection configuration of each pair of said tone synthesis units from:

(a) a mode in which the output of a first tone synthesis unit in the unit pair is utilized as at least part of a phase signal to the second module of a second tone synthesis unit in the unit pair; or (b) a mode in which the output of the first tone synthesis unit in the unit pair is used as at least part of a tone output from said tone generator.

15. The electronic musical instrument according to claim 13, further comprising display means for visually displaying the connection configuration of the plurality of modules according to the module-pairing data and the unit-pairing data inputted by the first and the second input means.

16. The electronic musical instrument according to claim 13, wherein said tone generator includes basic parameter generation means for generating phase signals and envelope signals each to be supplied to said each module, and said each module includes:

a first phase input port for receiving a phase signal from said basic parameter generation means;

a second phase input port for receiving an output signal from the first module;

a third phase input port for receiving an output signal from the first tone synthesis unit;

a fourth phase input port for receiving the sum of or difference between the output signal of the first module and output signal of the first tone synthesis unit;

phase selection means for selecting one of the first to fourth phase input ports according to said control data;

waveform generation means for generating a waveform signal by using a phase signal selected by said phase selection means;

a first envelope input port for receiving an envelope signal from said basic parameter generation means;

a second envelope input port for receiving the sum of the output signal of said first module and the envelope signal from said basic parameter generation means;

envelope selection means for selecting one of the first and second envelope input ports according to said control data; and means for multiplying the generated waveform signal by the selected envelope signal to form a module output signal.

17. An electronic musical instrument, comprising;

a tone generator for synthesizing musical tones, including waveform generation circuitry and means for driving said waveform generation circuitry in a time division manner so as to obtain in operation a plurality of modules;

said tone generator also including means for connecting said modules to one another in a selected one of a plurality of all possible connection configurations of said modules; and user operated means coupled to said tone generator, for designating a connection configuration of said plurality of modules from said plurality of all possible configurations, and for connecting a desired connection configuration of said plurality of modules in said tone generator.

18. The electronic musical instrument according to claim 17, further comprising display means for visually displaying the connection configuration of the plurality of modules designated by said user operated means.

* * * * *